United States Patent [19]

Clark

[11] 4,138,749

[45] Feb. 13, 1979

[54] TWO-STAGE HYDRAULIC FLUSH CONTROL DEVICE

[76] Inventor: Merlin W. Clark, Rte. 1, Box 171, Spanish Fork, Utah 84660

[21] Appl. No.: 821,677

[22] Filed: Aug. 4, 1977

[51] Int. Cl.[2] ..... E03D 1/14; E03D 1/34

[52] U.S. Cl. ..... 4/388; 4/324; 4/415

[58] Field of Search ..... 4/67 A, 67 R, 25, 28, 4/29, 56, 63, 324, 326, 345, 346, 363, 379, 388, 395, 405, 415

[56] References Cited

U.S. PATENT DOCUMENTS

| | | | |
|---|---|---|---|
| 990,132 | 4/1911 | Hodgkins | 4/67 R |
| 3,958,281 | 5/1976 | Remmel | 4/67 A |

*Primary Examiner*—Richard E. Aegerter
*Assistant Examiner*—Frederick R. Schmidt
*Attorney, Agent, or Firm*—H. Ross Workman; J. Winslow Young

[57] ABSTRACT

A two-stage hydraulic flush device for use in regulating the amount of water released when flushing a conventional water closet. The flush handle of a conventional water closet is actuated so as to unseat a drain plug in the water tank, and the piston of a hydraulic cylinder which is submersibly disposed within the water tank is then displaced to one of two distinct positions. As the piston is displaced, water is admitted into the cylinder below the piston. When the flush handle is released, water is expelled from the cylinder at a controlled rate as the piston is forcibly returned by a spring mechanism to its initial position. As the piston returns, the lifting arm is actuated so as to reseat the drain plug. The water outlet flow rate determines the duration of the flushing action, and two distinct piston positions define the two flush stages.

17 Claims, 5 Drawing Figures

TWO-STAGE HYDRAULIC FLUSH CONTROL DEVICE

BACKGROUND

1. Field of the Invention

This invention relates to improved water closet flushing devices, and more particularly to flush control devices in tank-type water closets.

2. The Prior Art

Millions of gallons of water are needlessly wasted every day through the use of conventional tank-type water closets. These water closets are designed to rapidly release a large quantity of water (about 3½ to 4 gallons or 13.75 to 15.14 liters) into the bowl of the water closet each time the flush handle is depressed. The force of such a quantity of water moving at the resulting velocity and flow rate enables a complete flushing of the contents of the bowl. However, this large quantity of water is not always needed to adequately flush the bowl.

For example, when flushing liquid waste as opposed to solid waste material, adequate flushing can be accomplished when using only 1½ to 2 gallons of water (5.68 to 7.51 liters), or about half the quantity of water which is normally used. As can be appreciated, by releasing a full tank of water each time a water closet is flushed, much water is needlessly wasted.

In an attempt to eliminate the unnecessary use of water when flushing a water closet, the prior art has developed two general concepts for providing plural level flush volumes in a water closet. One is the concept of plural level flush drains. Generally, devices of the type require complete removal or considerable modification of the drain plug assembly to accommodate installation of elaborate elongated donut-type float-valve cylinder and lid assemblies. See, for example, applicant's prior patent, U.S. Pat. No. 3,839,747. These types of devices also require modification of the flush handle lifting arm or the placement of stabilizing stop brackets on the water tank standpipe. Furthermore, once installed, no adjustment of the flush level within the water tank can be achieved to provide any variation in the fractional amount of water released when flushing the water closet in a fractional flush mode. These devices likewise provide no clear-cut distinction for the user between depression of the flush handle for a fractional flush and for a full flush. In order to use the water closet in the full flush mode, the user is required to hold the handle in a depressed position for a certain period of time before continued depression of the handle will allow a full flush, resulting in considerable inconvenience.

The other concept generally taught in the prior art involves selective weighting of the drain plug assembly. Generally, in devices of this type, one or more cup or sieve type structures is attached to the drain plug assembly. The additional weight forces the drain plug to reseat before a full flush is completed. While devices of this type offer the advantage of permitting adjustment within the water tank of the fractional flush volume, the other disadvantages of the plural level devices discussed above are also inherent in this type of device, e.g. difficulty of installation, drain plug assembly modification, and delay requirement to achieve a full flush. Moreover, to adjust the water level for a fractional flush in the weighted devices, several adjustments usually must be made which require removal and replacement of parts that are in inaccessible areas.

Because of the above-noted problems and disadvantages in these prior art concepts, the public has been reluctant to put them to use. Accordingly, it would be an improvement in the art to provide a plural level flush control device which may be easily installed in a conventional water closet, with little or no alteration of existing flush handles, lifting arms, or drain plug assemblies. It would also be an improvement over the art to provide for broad flexibility in varying the quantity of water releasable during a fractional flush, and to enable the operator to easily make the desired variations without removing and replacing the device. It would be yet a further improvement over the art to provide a plural level flush control device which distinctly differentiates the fractional flush mode from the full flush mode for the user so as to eliminate any inconvenient waiting period.

BRIEF SUMMARY AND OBJECTS OF THE INVENTION

The present invention provides a plural level flush control device which is structurally apart from the drain plug assembly so as to be easily installable in most conventional water closets without modification. Structure is provided on the flush control device which permits adjustment of the amount of water released during a fractional flush witout removal of the device after installation. Structure is also provided on the flush control device of the present invention which distinctly differentiates in its operation between the fractional flush and full flush modes.

It is, therefore, a primary object of the present invention to provide improved method and apparatus for a flush control device.

It is another object of the present invention to provide a flush control device which employs both a fractional flush and a full flush as desired by the operator.

Another object of this invention is to provide a flush control device which is capable of facile adjustment of the fractional flush stage without removal of the device, enabling broad flexibility in varying the quantity of water releasable during a fractional flush.

It is another object of this invention to provide a flush control device which is easily installable into conventional water closets with little or no modification to existing lifting arms and drain plugs.

Another object of this invention is to provide a flush control device which in its operation distinctly differentiates for the user between the fractional flush mode and the full flush mode.

These and other objects and features of the present invention will become more fully apparent from the following description and appended claims taken in conjunction with the accompanying drawing.

DETAILED DESCRIPTION OF THE PREFERRED EMBODIMENT

Reference is now made to the figures wherein like parts are designated with like numerals throughout.

Figure 1:
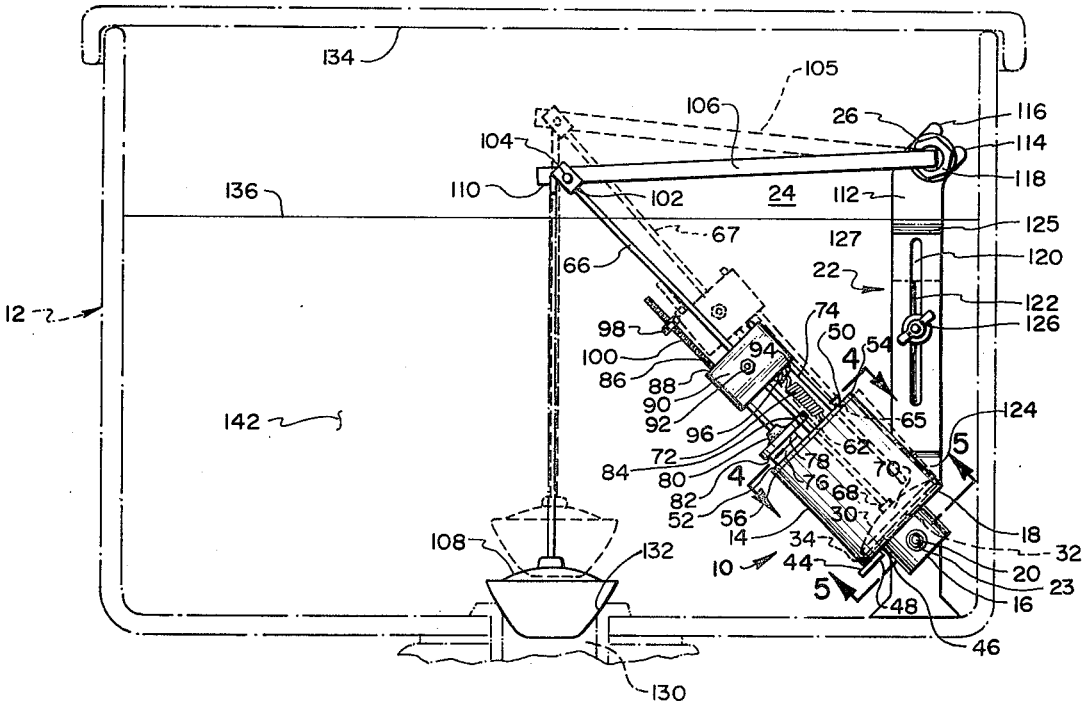
FIG. 1 is a side elevation of one presently preferred embodiment installed in a conventional water closet, dotted lines indicating the position assumed by various components of the device during initiation of a fractional flush.

With particular reference to FIG. 1, one presently preferred embodiment of the flush control device generally designated 10 is shown installed in a conventional water closet 12. The device 10 is illustrated immersed beneath water level 136. All of the components of flush device 10 are preferably constructed of aluminum or other corrosion-resistant material, except those hereinafter specifically mentioned.

Figure 2:
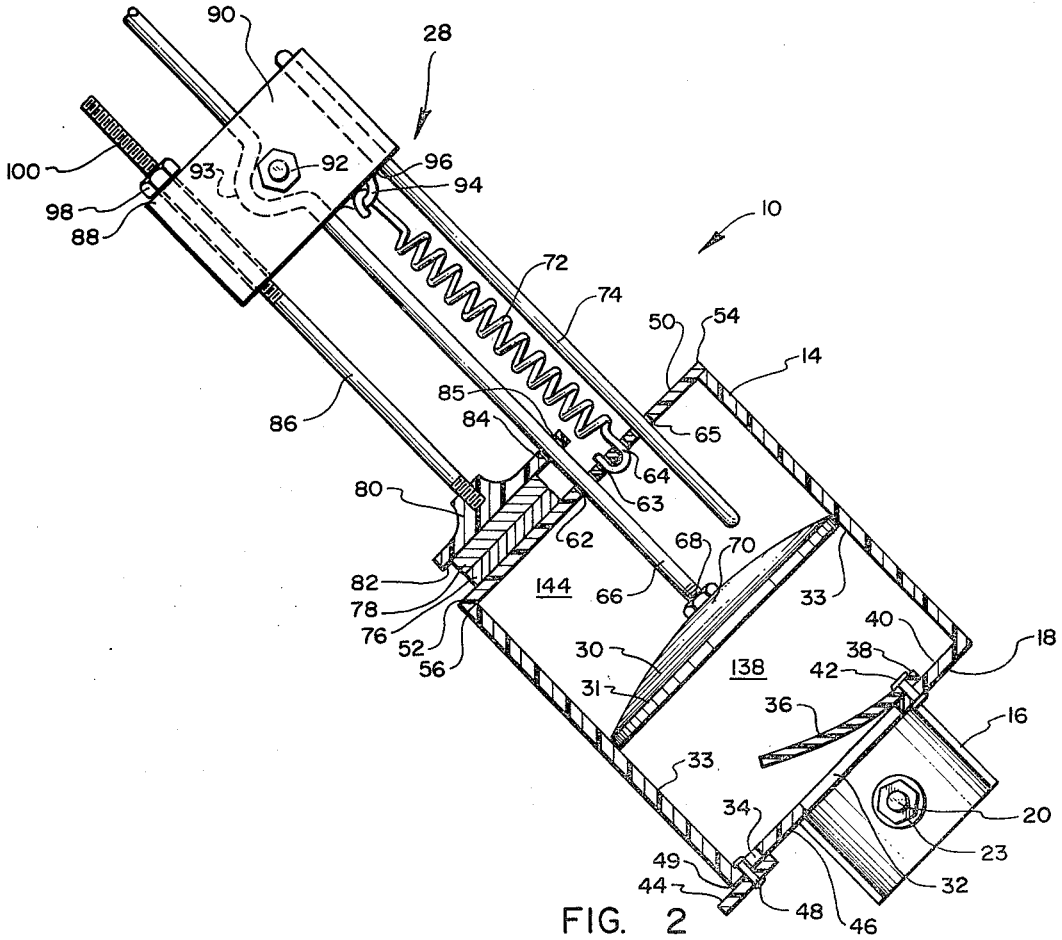
FIG. 2 is a fragmentary cross section of a portion of the embodiment of FIG. 1, indicating the positions of various components upon initiation of a fractional flush.
Figure 3:
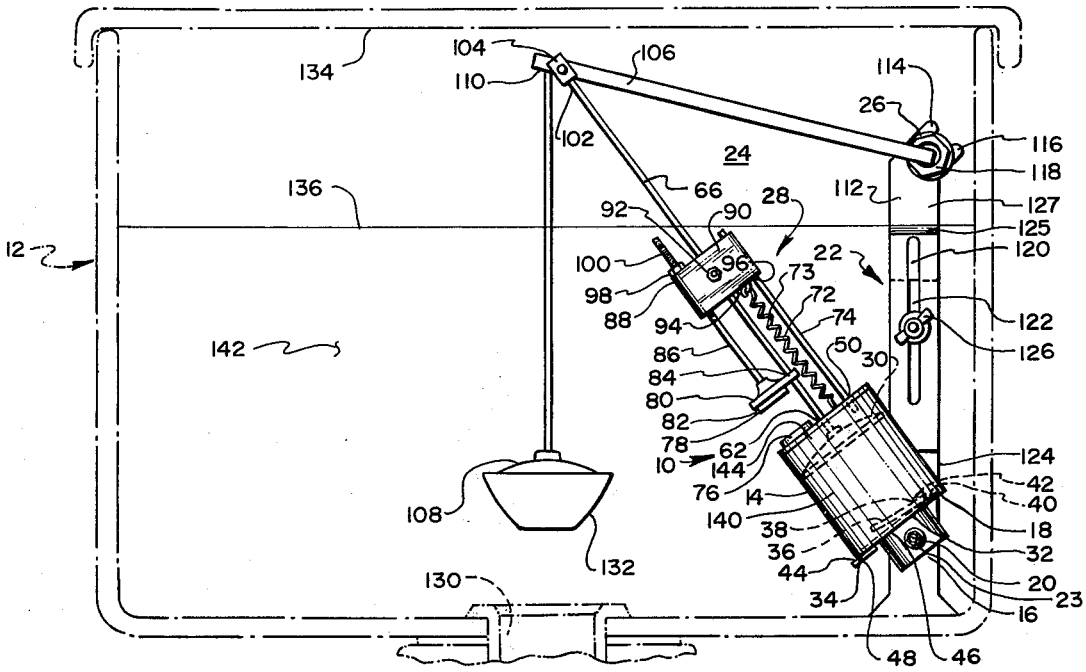
FIG. 3 is a side elevation of the FIG. 1 embodiment showing the fully extended positions of various components during initiation of a full flush.

Referring to FIG. 2, flush device 10 has a hollow cylinder 14 with an essentially closed cylinder bottom 18. In cylinder bottom 18 are placed inlet aperture 32 and outlet aperture 34 for water flow in and out of cylinder 14, respectively. Aperture 32, best seen in FIG. 5, is centrally positioned in cylinder bottom 18 and is circular in configuration. The diameter of aperture 32 is approximately one-third to one-half of the diameter of cylinder 14. Selectively covering aperture 32 is one-way flapper valve 36, essentially circular in configuration with diameter slightly larger than aperture 32, as seen best in FIGS. 2 and 5. Flapper valve 36 is hinged at portion 38 thereof to the upper surface 40 of cylinder bottom 18 by means of pin 42. As hereinafter more fully described, in response to water flow in and out of cylinder 14, flapper valve 36 assumes an open position as shown in FIGS. 2 and 3 and a closed position as shown in FIGS. 1, 4 and 5, respectively.

Outlet aperture 34, best seen in FIGS. 2 and 5, is substantially smaller than inlet aperture 32 and located near the outside periphery 49 of cylinder bottom 18. Selectively covering any predetermined portion of aperture 32 is adjustable deflector 44. Deflector 44 is rectangular in configuration and pivotally attached at its center to lower surface 46 of cylinder bottom 18 by means of pin 48. For purposes to be hereinafter more fully described, the lateral position of deflector 44 may be adjusted to cover any predetermined portion of aperture 34 by being pivoted about pin 48. Referring again to FIG. 2, it will be seen that piston 30 is disposed within cylinder 14 in compression-fit relationship. Peripheral edge 31 of piston 30 is dimensionally configurated with respect to inner surface 33 of cylinder 14 so as to prevent any appreciable water flow therebetween. Guide bracket 50, shown best in FIG. 4, is rigidly joined to the top of cylinder 14 at ends 52 and 54. Guide bracket 50 is elongated in shape so as to leave open spaces 58 and 60 on either side of guide bracket 50. Positioned approximately in the longitudinal center line of guide bracket 50 are apertures 62 through 65. Aperture 62 is positioned approximately at the midpoint of the longitudinal center line of guide bracket 50. Passing through aperture 62 in free movement relationship is piston rod 66, as shown in FIG. 2. The lower end 68 of piston rod 66 is rigidly attached or bolted to upper surface 70 of piston 30, in the center thereof.

Referring again to FIG. 4, apertures 63 and 64 in slide bracket 50 are positioned radially outward from aperture 62, and provide a lower anchor position for spring 72 (see also FIG. 2). Spring 72 is constructed of conventional spring steel or any other suitable resilient material, and may be coated with rubber or plastic coating to prevent corrosion within the water closet 12. Aperture 65 is positioned approximately one-half to three-fourths of the distance from the midpoint on the longitudinal center line to the outer end 54 of bracket 50. Passing through aperture 65 in free movement relationship is guide rod 74, shown best in FIG. 2. Guide rod 74 is parallel to piston rod 66.

Figure 4:
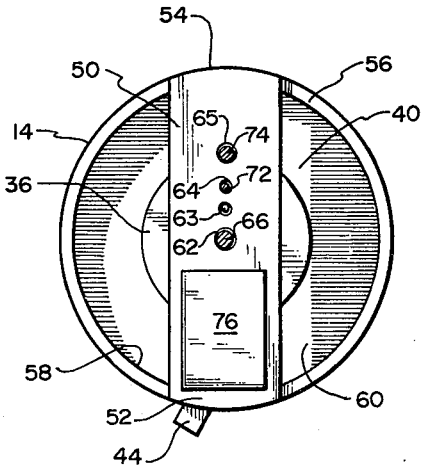
FIG. 4 is a cross section taken along line 4—4 of FIG. 1.
Figure 5:
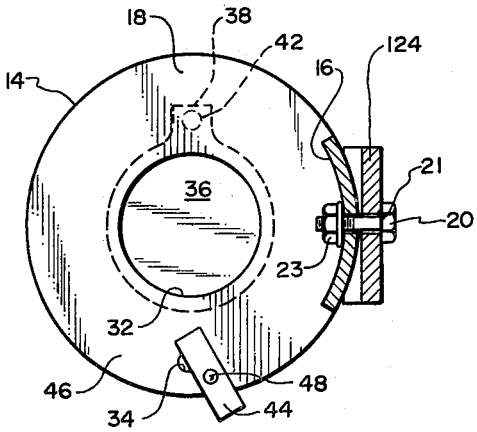
FIG. 5 is a cross section taken along line 5—5 of FIG. 1.

With continued reference to FIGS. 2 and 4, lower magnet 76, constructed of conventional magnetic iron, is rigidly joined by the use of screws (not shown) or other suitable attachment to bracket 50 on the upper surface thereof. Magnet 76 is of essentially flat, rectangular configuration and has a rubber or plastic coating to prevent corrosion within the water closet 12. Upper magnet 78, constructed of conventional magnetic iron, is of configuration similar to magnet 76 and likewise has a rubber or plastic coating to prevent corrosion within water closet 12. Magnet 78 is shown in FIG. 2 in magnetic contact with lower magnet 76 through magnet covers 77 and 79. Upper magnet bracket 80 is rigidly joined by the use of screws (not shown) or other suitable attachment to upper magnet 78 at surface 82. Arm 84 of bracket 80 is extended and has a slot 85 through which piston rod 66 extends, thereby maintaining proper alignment of the upper magnet bracket 80 during use, as will be hereinafter described. Restraining rod 86 is threaded into or otherwise suitably joined to upper magnet bracket 80.

With continued reference to FIG. 2, slide bracket 90 is rigidly joined to piston rod 66 and guide rod 74 by means of bolt 92, maintaining piston rod 66 and guide rod 74 in substantially co-parallel positions. Piston rod 66 has a dogleg 93 positioned opposite bolt 92 to facilitate attachment of slide bracket 90 to piston rod 66. Portion 88 of slide bracket 90 forms a sleeve through which restraining rod 86 passes in free movement relationship. Restraining rod 86 is thus maintained in a substantially co-parallel position with piston rod 66 and guide rod 74. Catch nut 98 is adjustably positioned on threads 100 of restraining rod 86 and selectively engages slide bracket 90 during use, as will be hereinafter described more fully. A loop 94 is rigidly joined to lower surface 96 of slide bracket 90 between the piston rod 66 and guide rod 74. Loop 94 serves as an upper attachment for spring 72.

Referring now to FIG. 1, it will be seen that end 102 of piston rod 66 is pivotally attached by pin 104 to the free end 110 of lifting arm 106. Drain plug 108 is suspended from end 110 of lifting arm 106 as in a conventional water closet. Drain plug 108 and lifting arm 106 are components of most types of conventional water closets now commercially available. The solid line illustration in FIG. 1 shows drain plug 108 positioned in seat 132 above drain 130.

With continued reference to FIG. 1, wall bracket assembly 22 is shown installed within water closet 12. Assembly 22 has upper brace 112 with arms 114 and 116 which partially encircle flush-handle shaft housing 26. Brace 112 is attached to housing 26 by means of nut 118. Brace 112 is of essentially rectangular configuration, having an elongated slot 120 centrally positioned therein. Positioned between upper brace 112 and water closet wall 24 is lower brace 124. Centrally positioned in lower brace 124 is an elongated slot 122 which corresponds to slot 120 of upper brace 112. Upper brace 112 and lower brace 124 are configurated so as to assume a coplanar position flush with water closet wall 24. Braces 112 and 124 may be slidably extended to any desired height and then locked by wing nut 126. Thus, wall bracket assembly 22 may be adapted to correspond to various water closet wall heights so as to enable the hydraulic cylinder assembly to be submersibly disposed therewithin.

As shown in FIGS. 1 and 2, lower brace 124 is provided with aperture 21 through which pivot bolt 20 extends. Pivot bolt 20 pivotally attaches base 16 of cylinder 14 to lower brace 124. The attachment at pivot bolt 20 allows the entire hydraulic cylinder assembly to pivot about pivot bolt 20 during use.

Attention is now drawn to FIGS. 1–3 in connection with a description of the method of use of the hydraulic flush control device of the present invention. The solid line illustration in FIG. 1 represents the initial position assumed by the flush control device 10 prior to flushing the water closet. As lifting arm 106 is raised to the position illustrated by broken lines 105, piston rod 66 is correspondingly elevated as shown by broken lines 67. As shown in FIG. 2, as piston rod 66 is elevated, it is also drawn upwards thereby upwardly displacing piston 30, slide bracket 90 and guide rod 74. Spring 72 is partially extended as slide bracket 90 is displaced and the entire flush device 10 rotates slightly about pivot bolt 20 in order to maintain the alignment of the flush device 10 with the lifting force on lifting arm 106, as shown by broken lines 67 in FIG. 1. As piston 30 rises within cylinder 14, water 142 from water closet 12 is admitted into cylinder 14 through inlet aperture 32, flowing past one-way flapper valve 36 and filling space 138. At the same time, water in space 144 above piston 30 is displaced out of cylinder 14 and into the main cavity of water closet 12 through openings 58 and 60 in the top of cylinder 14.

As shown in FIG. 2, in response to actuation of lifting arm 106, slide bracket 90 will slide up restraining rod 86 until slide bracket 90 engages catch nut 98. Once slide bracket 90 engages catch nut 98, further upward displacement of slide bracket 90 and piston 30 will be restrained by reason of the magnetic attraction between magnets 78 and 76. Significantly, this magnetic restraint on the upward displacement of piston 30 defines a discrete first flushing position which is readily discernible by the user. Furthermore, it should be noted that this first discrete flushing position at which piston 30 is magnetically restrained may be easily adjusted simply by screwing nut 98 up or down on the end 100 of restraining rod 86. For purposes hereinafter more fully described, by adjustment of nut 98 so as to suitably set the first flushing position of piston 30, only a predetermined space 138 within cylinder 14 will be filled with water.

If the user desires to release only half or some other fractional amount of the water held in the water tank 12, the flush handle is released when upward displacement of piston 30 is forcibly restrained by the magnets 78–79 as shown in FIG. 2. Then, as the water level 136 of water closet 12 begins to subside, piston 30 is urged by spring 72 to return to its original position, the tension force in spring 72 being supplemented by hydraulic induction and gravity. In response to the pressure exerted on the water in space 138, flapper valve 36 assumes a closed position. As the water level 136 in water closet 12 continues to subside, piston 30 continues its downward motion and the water in space 138 is urged out of cylinder 14 through aperture 34 at a flow rate determined by the lateral position of deflector 44 with respect to aperture 34. The flow rate so determined controls the speed with which piston 30 and correspondingly lifting arm 106 and drain plug 108 return to their respective original positions, shown by the solid line illustration in FIG. 1, thereby terminating the flush. The relative distance to be travelled by piston 30 along the length of cylinder 14 in returning to original position and the corresponding volume of water in space 138 to be expelled from cylinder 14 through aperture 34 during a fractional flush are determined by the positioning of catch nut 98 as described previously.

The speed of return to original position of piston 30 and the distance to be travelled by piston 30 during a fractional flush determine the time interval elapsing before drain plug 108 returns to its seat 132, terminating the flush. The resulting time interval determines the portion of the total quantity of water in the water closet 12 which will be flushed down drain 130 into the toilet bowl (not shown) during a fractional flush. As demonstrated, the speed of return of the drain plug 108 to original position and the relative distance to be travelled in a fractional flush are easily adjustable by changing the lateral positioning of deflector 44 with respect to aperture 34 and changing the vertical positioning of catch nut 98 on threads 100 of restraining rod 86, respectively. These adjustments are easily accomplished from above the water closet through access lid 134 by the operator after installation and without removal of the flush device 10. Accordingly, this enables broad flexibility in varying the amount of water releasable from water closet 12 during a fractional flush.

In order to release the entire amount of water held in the water tank, the same procedure as described above in connection with a fractional flush is employed. However, when the piston 30 is magnetically restrained at its first flush position, approximately midway between the ends of cylinder 14 (see FIG. 2), the user must then exert sufficient additional force on lifting arm 106 to break the magnetic contact between magnets 76 and 78. Once the magnetic contact is broken, the piston 30 will advance upwardly to the position shown in FIG. 3. Spring 72 will be substantially extended as shown, and the entire flush device will rotate slightly about pivot bolt 20 in order to maintain alignment of flush device 10 with the lifting force on lifting arm 106. Lifting arm 106 and drain plug 108 will be further raised to the positions represented in FIG. 3, and the piston 30 will be disposed near the top of cylinder 14, thereby admitting water into substantially the entire cylinder cavity.

As with a fractional flush, as the water level 136 in water closet 12 begins to subside, piston 30 will be forcibly returned by spring 72 to its original position. In the same manner as described in connection with a fractional flush, flapper valve 36 will close and water will be expelled through aperture 34 at a flow rate dependent upon the position of deflector 44. Since the entire cylinder cavity has been filled with water, the piston 30 and correspondingly lifting arm 106 and drain plug 108 will take longer to reseat, thereby permitting essentially all of the water in water tank 12 to be flushed.

From the foregoing description, it will be appreciated that the method and apparatus of the hydraulic flush control device of the present invention accommodates easy installation in a conventional water closet without having to modify the drain plug assembly or other structure of the water closet. Furthermore, the flush control device of this invention may be easily adjusted to vary the amount of water released during a fractional flush. The present invention likewise distinctly differentiates in its operation between the fractional flush and full flush positions for the user.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A hydraulic flush device in combination with a water closet having a water tank, a flush handle lifting arm, and a drain plug connected to the lifting arm, said hydraulic flush device being selectively adjustable to control the amount of water released when flushing said water closet and comprising:

a hollow cylinder submersibly disposed within the water tank, said cylinder having a first end and a second end, at least one of said ends comprising inlet valve means for admitting water unidirectionally into the hollow of said cylinder and outlet valve means for expelling water from said cylinder, said outlet valve means comprising means for selectively varying the rate at which water is expelled from said cylinder;

a reciprocable piston disposed within the cylinder;

means for joining said piston to said lifting arm so as to displace said piston simultaneously with the opening of said drain plug, the displacement of said piston drawing water through said inlet valve means into the hollow of said cylinder; and means for urging the piston against the water admitted into the cylinder so as to return said piston and the drain plug connected to said lifting arm to their initial rest positions as water is expelled by said piston through the outlet valve means.

2. A hydraulic flush device as defined in claim 1 further comprising bracket means attachable to the water tank wall for pivotally securing the cylinder thereto, said bracket means comprising means for adjusting the bracket means so as to maintain the cylinder submersibly disposed within the water tank.

3. A hydraulic flush device as defined in claim 1 further comprising means for restraining displacement of the piston at a first discrete flushing position and means responsive to additional force on the lifting arm for restraining displacement of the piston of the second discrete flushing position.

4. A hydraulic flush device as defined in claim 3 wherein the means for restraining displacement of the piston at the first discrete flushing position comprise means for adjusting said displacement, thereby enabling selection of any one of a plurality of predetermined first discrete flushing positions.

5. A hydraulic flush device as defined in claim 4 wherein said restraining means further comprise means for magnetically restraining displacement of said piston at the first discrete flushing position.

6. A hydraulic flush control device in combination with a water closet having a water tank, a flush handle lifting arm, and a drain plug connected to the lifting arm, said hydraulic flush control device being selectively operable to control the amount of water released when flushing said water closet and comprising:

a hollow cylinder submersibly disposed within the water tank, said cylinder having a first end and a second end, at least one of said ends comprising water inlet means and water outlet means;

a reciprocable piston disposed within the cylinder;

means for joining said piston to said lifting arm so as to displace said piston simultaneously with the opening of the drain plug connected to said lifting arm, said displacement of the piston drawing water through the water inlet means into the cylinder beneath the piston;

means for releasably restraining displacement of the piston at a first discrete flushing position;

means responsive to additional force on the lifting arm for further restraining displacement of the piston at a second discrete flushing position after said means for releasably restraining the piston at the first position have been overcome by said additional force; and means for urging the piston against the water admitted into the cylinder so as to return said piston and the drain plug connected to said lifting arm to their respective initial positions as water is expelled by said piston through the water outlet means.

7. A hydraulic flush device as defined in claim 6 wherein the means for restraining displacement of the piston at the first flushing position comprise means for adjusting said displacement, thereby enabling selection of any one of a plurality of predetermined first discrete flushing positions.

8. A hydraulic flush device as defined in claim 6 wherein the water outlet means comprises means for varying the water outlet flow rate, thereby accommodating adjustment of the delay time for return of the piston to its initial rest position.

9. A hydraulic flush device as defined in claim 6 further comprising a bracket to which said cylinder is pivotally attached, said bracket comprising means for adjusting placement of the cylinder within the water tank so as to enable the cylinder to be submersibly disposed therewithin.

10. A hydraulic flush device as defined in claim 6 further comprising means for magnetically restraining displacement of said piston at the first discrete flushing position.

11. A hydraulic flush control device for selectively regulating the amount of water released when flushing a water closet, the water closet having a water tank, a flush handle lifting arm, and a drain plug connected to the lifting arm, the hydraulic flush control device comprising:

a hollow cylinder submersibly disposed within the water tank and having a first substantially open end and a second substantially closed end, said closed end comprising water inlet means and water outlet means, the water inlet means having a unidirectional valve to accommodate a greater flow rate than the water outlet means, and the water outlet means having an adjustable aperture to accommodate various flow rates;

means attachable to the water tank wall for pivotally securing the cylinder thereto, said securing means comprising means for adjusting vertical orientation of the cylinder within the water tank so as to enable the cylinder to be submersibly disposed therewithin;

a reciprocable piston disposed within the cylinder;

means for joining the piston to the lifting arm so as to displace the piston simultaneously with opening of the drain plug, said displacement admitting water through the water inlet means into the cylinder beneath the piston;

means for releasably restraining displacement of the piston at a predetermined first flushing position, said releasable restraining means comprising means for magnetically restraining displacement of the piston and means for adjusting the position at which said displacement is restrained;

means responsive to additional force on the lifting arm for further restraining displacement of the piston at a second discrete flushing position after said means for magnetically restraining the piston at the first position have been overcome by said additional force; and means for returning the piston from one of said first and second positions to its initial rest position, thereby regulating the amount of water released from the water tank by selectively varying the time delay in returning the lifting arm and the drain plug.

12. In a water closet having a water tank, a flush handle lifting arm, a drain plug connected to the lifting arm, a cylinder having water inlet means and water outlet means, said water outlet means comprising means for adjusting the rate of flow of water expelled through said water outlet means, a piston reciprocably disposed within the cylinder and joined to the lifting arm, and means for urging the piston against the water admitted into the cylinder, a method of selectively regulating the amount of water released when flushing said water closet, the method comprising the steps of:

actuating the lifting arm so as to simultaneously remove the drain plug and displace the piston within the cylinder;

drawing water through said water inlet means into the hollow of said cylinder beneath said piston as said piston is displaced;

expelling water through said water outlet means as said means for urging the piston against the water admitted into said cylinder returns said piston and the drain plug connected to said lifting arm to their respective initial positions; and controlling the rate at which water is expelled through said water outlet means by selectively adjusting said means for adjusting the water outlet means.

13. A method of selectively regulating the amount of water released when flushing a water closet, said water closet having a water tank, a flush handle lifting arm, a drain plug connected to the lifting arm, a cylinder having water inlet means and water outlet means, and a piston reciprocably disposed within the cylinder and joined to the lifting arm, the method comprising the steps of:

actuating the lifting arm so as to simultaneously remove the drain plug and displace the piston within the cylinder, thereby admitting water through the water inlet means into the cylinder beneath the piston;

releasably restraining displacement of the piston at a first discrete flushing position;

further actuating the lifting arm so as to overcome the restraint imposed upon the displacement of said piston at the first flushing position;

restraining displacement of the piston at a second discrete flushing position after said restraint at the first position has been overcome by further actuation of the lifting arm;

returning the piston from one of said first and second positions to its initial rest position, thereby actuating the lifting arm and replacing the drain plug; and selectively varying the time delay in returning the piston from said first and second positions, thereby accommodating selective regulation of the amount of water released from the water tank when flushing the water closet.

14. A method as defined in claim 13 wherein said step of releasably restraining the piston at the first position comprises magnetically restraining displacement of the piston.

15. A method as defined in claim 14 further comprising the step of adjusting the position at which said piston is magnetically restrained.

16. A method as defined in claim 13 wherein said step of selectively varying the time delay comprises adjusting the water outlet means so as to vary the water outlet flow rate.

17. A method as defined in claim 13 further comprising the step of adjusting placement of the cylinder within the water tank so as to enable the cylinder to be submersibly disposed therewithin.

* * * * *